United States Patent [19]

Une

[11] Patent Number: 4,977,710

[45] Date of Patent: Dec. 18, 1990

[54] METAL BONDED DIAMOND WHEEL

[75] Inventor: Kouji Une, Kawasaki, Japan

[73] Assignee: Asahi Diamond Industrial Co., Ltd., Tokyo, Japan

[21] Appl. No.: 305,371

[22] Filed: Feb. 1, 1989

[30] Foreign Application Priority Data

Sep. 13, 1988 [JP] Japan ..... 63-227457

[51] Int. Cl.[5] ..... B24D 3/02

[52] U.S. Cl. ..... 51/309; 51/295; 51/298; 75/228; 75/242; 428/570

[58] Field of Search ..... 51/93, 309, 298, 295; 75/228, 242; 428/570

[56] References Cited

U.S. PATENT DOCUMENTS

| | | | |
|---|---|---|---|
| 4,246,006 | 1/1981 | Phaal | 51/309 |
| 4,278,448 | 7/1981 | Ishizuka et al. | 51/295 |
| 4,362,535 | 12/1982 | Isobe et al. | 51/293 |
| 4,373,934 | 2/1983 | Hayden | 51/309 |
| 4,399,167 | 8/1983 | Pipkin | 51/295 |
| 4,591,363 | 5/1986 | Silverman | 51/293 |
| 4,591,364 | 5/1986 | Phaal | 51/309 |
| 4,618,349 | 10/1986 | Hashimoto et al. | 51/298 |

*Primary Examiner*—Paul Lieberman
*Assistant Examiner*—Willie J. Thompson
*Attorney, Agent, or Firm*—Frishauf, Holtz, Goodman & Woodward

[57] ABSTRACT

The metal bonded diamond wheel of the invention has a sintered body of a mixture of a diamond powder and a bonding metal powder. The particles of the bonding metal powder or, preferably, particles of both of the diamond powder and the bonding metal powder are provided, prior to powder metallurgical sintering, with a coating layer of iron, cobalt or nickel, in a thickness of 0.5 to 15 μm. When sintered under adequate conditions, the sintered body has pores in a porosity of 10 to 25% and exhibits greatly improved grinding performance relative to the durability in grinding works and sharpness of grinding with a decreased resistance of grinding.

21 Claims, 1 Drawing Sheet

METAL BONDED DIAMOND WHEEL

BACKGROUND OF THE INVENTION

The present invention relates to a metal bonded diamond wheel. More particularly, the invention relates to a wheel having a sintered body of metal-bonded diamond suitable for grinding works of glass, ceramics, cermets and the like capable of exhibiting excellent grindability with low grinding resistance and long wear performance.

The grinding of glass, ceramics, cermets and the like materials in the prior art are performed mostly by using a metal-bonded diamond wheel in view of the excellent grindability and long wear performance. Such a diamond wheel has a structure composed of a metal base and a layer of a powder-metallurgically formed thereon from a mixture of a diamond powder and a metal powder to serve as a bonding material of the diamond particles. FIG. 1 illustrates a grinding wheel for edge rounder by a cross section as an example of such a metal-bonded diamond wheel, in which a layer of a sintered body 5 is provided in the cavity of a metal core 6.

Among various kinds of metals and alloys used as a metallic bonding material of a diamond powder, a particularly preferred is an alloy of copper and tin when the intended use of the diamond wheel is for grinding of glass, ceramics, cermets and the like. Diamond tools prepared by using an alloy of copper and tin as the metallic bonding material of diamond particles, however, have a disadvantage due to the relatively low holding power for the diamond particles that the durability of the wheel is low with relatively rapid wearing of the metal-bonding and the configuration of the grinding surface is subject to changes during use of the wheel although the grinding resistance is low to exhibit good sharpness of grinding as a consequence of rapid refreshing of the grinding surface because of falling of the abrasive diamond particles.

The holding power of the metallic bonding material for diamond particles can be improved by using nickel, cobalt, iron or an alloy of these metals as the bonding material. These metals and alloys, however, have a relatively high melting point so that sufficient sintering can be obtained only by performing the powder metallurgical sintering process at a high temperature of, for example, 900° C. or higher while the diamond particles are rapidly graphitized at such a high temperature to cause a loss in the grinding power of the diamond particles. The grinding power of diamond particles can be maintained when the particles are coated with a metal of high melting point such as tungsten or an alloy of tungsten although this method is unavoidably accompanied by another problem that the grindability of wheel is decreased as a consequence of the high wearing resistance of the bonding.

SUMMARY OF THE INVENTION

The present invention accordingly has an object to provide a metal bonded diamond wheel capable of exhibiting excellent grindability with outstandingly low resistance of grinding and having a long wear performance to be suitable as a grinding wheel for glass, ceramics, cermets and the like without the above described problems and disadvantages in the prior art metal bonded diamond wheel.

The metal bonded diamond wheel of the present invention comprises a powder metallurgically sintered body of a mixture of a diamond powder and a powder of a bonding metal of which the particles are coated with a metal belonging to the VIII th Group of the Periodic Table or an alloy mainly composed thereof, preferably, in a coating thickness in the range from 0.5 to 15 μm.

Particles of the diamond powder may also be coated with a metal belonging to the VIII th Group of the Periodic Table, preferably, in a coating thickness in the range from 0.5 to 15 μm.

The diamond powder and the powder of the bonding metal are blended in a mixing ratio in the range from 5:95 to 20:80 by volume and the powder mixture is subjected to a powder metallurgical sintering treatment at a temperature in the range from 450° to 700° C. in an atmosphere of a reducing gas.

DETAILED DESCRIPTION OF THE PREFERRED EMBODIMENTS

Figure 1:
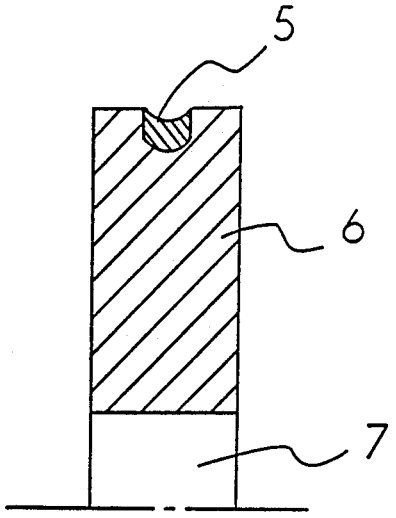
FIG. 1 PRIOR ART
FIG. 1 is a schematic cross sectional view of a metal bonded diamond wheel for edge rounder.

As is described above, the most characteristic feature of the metal bonded diamond wheel according to the invention is that the sintered body of the metal-bonded diamond is obtained from a mixture of a diamond powder and a powder of a bonding metal of which the particles are coated with a specific metal or an alloy thereof. By this means, the sintered body has a network-like structure of the coating metal or alloy including pores or voids in which the particles of diamond are firmly held so that the above described object of the invention can be achieved.

The sintered body of the inventive grinding wheel is prepared by powder metallurgically sintering a mixture of a diamond powder and a powder of a bonding metal of which the particles are coated with a metal belonging to the VIII th Group of the Periodic Table or an alloy mainly composed thereof. Examples of the metal belonging to the VIII th Group of the Periodic Table include iron, cobalt, nickel, ruthenium, rhodium, palladium, platinum and the like. These metals can be used either singly or as a combination or an alloy of two kinds or more according to need.

The method for coating the particles of the bonding metal with the above named coating metal or alloy is not particularly limiting including the methods of physical vapor-deposition, e.g., vacuum vapor deposition, sputtering and ion plating, methods of chemical vapor deposition, electrolytic plating, electroless plating and the like.

Various kinds of bonding metals can be used without particular limitations including conventional metals and alloys used in the preparation of metal bonded diamond wheel in the prior art. Preferable examples of the bonding metal or alloy include bronze-like alloys of copper and tin and brass-like alloys of copper and zinc. Particles of the bonding metal or alloy usually should have a particle diameter in the range from 10 to 500 μm. The particles of the bonding metal or alloy are provided with a coating layer of a metal belonging to the VIII th Group of the Periodic Table or an alloy mainly composed thereof. The coating layer should preferably have a thickness of the range from 0.5 to 15 μm. When the thickness of the coating layer is too small, the desired improvement as the object of the invention cannot be fully achieved. When the thickness of the coating layer is too large, on the other hand, the grinding performance of the grinding wheel is somewhat decreased.

The origin of the diamond powder is not particularly limiting and natural and synthetic diamond can be used equally satisfactorily. The diamond powder should preferably have a particle diameter in the range from 10 to 500 μm. It is optional but preferable that the particles of the diamond powder are also provided, like the particles of the bonding metal or alloy, with a coating layer of a metal belonging to the VIII th Group of the Periodic Table or an alloy mainly composed thereof in view of the improvement in the grinding performance obtained thereby. The kind of the coating metal and the method for coating can be the same as in the coating of the particles of the bonding metal or alloy. The thickness of the coating layer on the diamond particles is also preferably in the range from 0.5 to 15 μm in order that the improvement to be obtained by the coating can be fully obtained.

The sintered body of metal-bonded diamond in the inventive grinding wheel is prepared by blending the diamond powder and the powder of the bonding metal in a mixing ratio preferably in the range from 5:95 to 20:80 by volume and subjecting the powder mixture to a powder metallurgical sintering treatment in an atmosphere of a reducing gas at a relatively low temperature in the range from about 450° C. to about 700° C. under a pressure preferably in the range from 100 to 1500 kg/cm$^2$.

Since the temperature for the sintering treatment is relatively low as is mentioned above, it is possible in the sintered body of the metal-bonded diamond of the inventive grinding wheel to leave pores in a desired proportion or porosity therein by adequately controlling the pressure within the above mentioned range because the sintering process does not proceed to a full extent between the particles of the bonding metal at such a relatively low sintering temperature. The porosity should preferably be in the range from 10 to 25%. When the porosity is too small, grindability of the grinding wheel in grinding is not sufficient with a somewhat increased resistance of grinding. When the porosity is too high, on the other hand, the mechanical strength of the sintered body would be too low so that the wheel no longer works as a grinding wheel. Needless to say, a lower porosity of the sintered body can be obtained by increasing the pressure in the sintering treatment.

Figure 2:
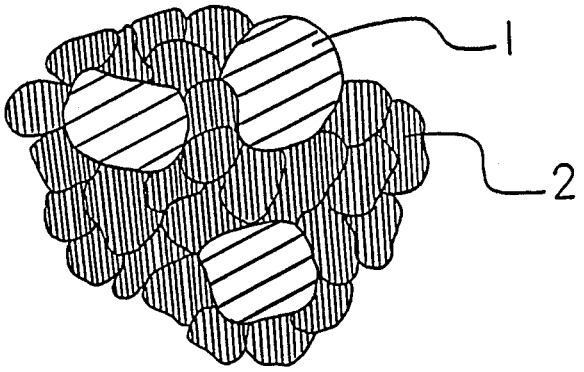
FIG. 2 PRIOR ART
FIGS. 2 and 3 each schematically illustrate the structure of the sintered body of metal-bonded diamond in the grinding wheels of the prior art and of the present invention, respectively.
Figure 3:
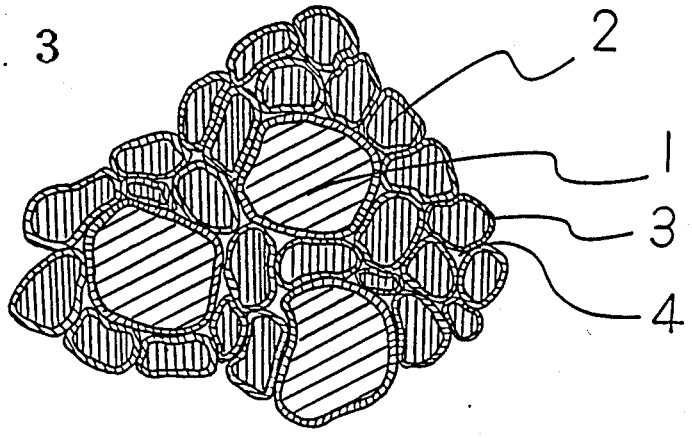

The sintered body of metal-bonded diamond prepared in the above described manner has a structure schematically illustrated in FIG. 3, in which the particles of diamond 1 and the particles of the bonding metal or alloy 2 are each provided with a coating layer 3 of the above specified coating metal or alloy and the particles are sintered together leaving pores or voids 4 therebetween. In other words, the diamond particles 1 having a coating layer 3 are firmly held in the network structure formed by the particles of the bonding metal 2 having a coating layer 3 including the pores 4. This structure is unique in contrast with the structure of a sintered body of metal-bonded diamond in conventional grinding wheels illustrated schematically in FIG. 2, in which the particles of diamond 1 and the particles of the bonding metal 2 are tightly sintered together without leaving any pores or interstices.

In the following, examples are given to illustrate the grinding wheel of the invention in more detail but not to limit the scope of the invention in any way.

EXAMPLE 1

Particles of a copper powder and a powder of a copper-tin alloy having a composition of bonding composed of 80% by weight of copper and 20% by weight of tin were coated with a coating layer of nickel having a thickness of 10 μm by sputtering. Separately, particles of a diamond powder of #140 grit size were coated similarly with a coating layer of nickel having a thickness of 10 μm by sputtering.

In the next place, the nickel-coated bonding metal powder and the nickel-coated diamond powder were blended in a proportion of 90:10 by volume by using an attrition machine. A metal mold was filled with the thus prepared powder mixture which was subjected to a sintering treatment in a reducing atmosphere of hydrogen gas at a temperature of 600° C. under a pressure of 500 kg/cm$^2$. The thus obtained sintered body had a porosity of 20%. The sintered body was mechanically worked to fabricate a grinding wheel for grinding of glass.

A grinding test of glass plates was performed on a horizontal spindle surface grinder using the above prepared grinding wheel. The results are shown in Table 1 below. For comparison, the same test as above was repeated except that the sintered body of the grinding wheel was prepared from the diamond powder and the bonding metal powder without a coating layer of nickel. The results of this comparative test are also shown in Table 1.

The results shown in Table 1 clearly indicate that a 30% extension of the wheel life or performance was obtained with the inventive grinding wheel prepared from the nickel-coated powders over that of the conventional grinding wheel and the grindability was improved with the inventive grinding wheel as is evidenced by the decrease of the electric current on the main spindle by 1 ampere representing the resistance of grinding.

EXAMPLE 2

Particles of the same bonding metal powder as used in Example 1 were coated with nickel in a thickness of 1 μm by sputtering. Similarly, particles of the same diamond powder as used in Example 1 were coated with nickel in a thickness of 1 μm by sputtering.

The nickel-coated bonding metal powder and the nickel-coated diamond powder were blended together in a proportion of 90:10 by volume using an attrition machine and the powder mixture was subjected to a sintering treatment in the same manner as in Example 1 excepting an increase of the pressure to 1000 kg/cm$^2$. The thus obtained sintered body had a porosity of 15%.

The sintered body was fabricated into a grinding wheel for grinding of glass which was used in a grinding test of glass plates in the same manner as in Example 1 to give the results shown in Table 1.

The results shown in Table 1 indicate that a 20% extension of the durability was obtained with the inventive grinding wheel prepared from the nickel-coated powders over that of the conventional grinding wheel and the grindability was improved with the inventive grinding wheel as is evidenced by the decrease of the electric current on the main spindle of the surface grinder by 1 ampere representing the resistance of grinding.

EXAMPLE 3

Particles of the same bonding metal powder as used in Example 1 were coated with iron in a thickness of 10 μm by sputtering. Similarly, particles of the same diamond powder as used in Example 1 were coated with iron in a thickness of 10 μm by sputtering.

The iron-coated bonding metal powder and the iron-coated diamond powder were blended together in a mixing proportion of 90:10 by volume using an attrition machine and the powder mixture was subjected to a sintering treatment in the same manner as in Example 2 to give a sintered body which had a porosity of 15%.

The sintered body was fabricated into a grinding wheel for grinding of glass which was used in a grinding test of glass plates in the same manner as in Example 1 to give the results of the grinding performance shown in Table 1.

The results shown in Table 1 indicate that a 20% extension of the wheel life or performance was obtained with the inventive grinding wheel prepared from the iron-coated powders over that of the conventional grinding wheel and the grindability was improved with the inventive grinding wheel as is evidenced by the decrease of the electric current on the main shaft of the surface grinder by 1 ampere representing the resistance of grinding.

EXAMPLE 4

Particles of the same bonding metal powder as used in Example 1 were coated with palladium in a thickness of 1 μm by sputtering. Similarly, particles of the same diamond powder as used in Example 1 were coated with palladium in a thickness of 1 μm by sputtering.

The palladium-coated bonding metal powder and the palladium-coated diamond powder were blended together in a mixing proportion of 90:10 by volume using a pestle and the powder mixture was subjected to a sintering treatment in the same manner as in Example 2 to give a sintered body having a porosity of 15%.

The sintered body was fabricated into a grinding wheel for grinding of glass which was used in a grinding test of glass plates in the same manner as in Example 1 to give the results of the grinding performance shown in Table 1.

The results shown in Table 1 indicate that a 15% extension of the wheel life or performance was obtained with the inventive grinding wheel prepared from the palladium-coated powders over that of the conventional grinding wheel and the grindability was improved with the inventive grinding wheel as is evidenced by the decrease of the electric current on the main spindle of the surface grinder by 1 ampere representing the grinding resistance.

EXAMPLE 5

Particles of the same bonding metal powder as used in Example 1 were coated with platinum in a thickness of 1 μm by sputtering. Similarly, particles of the same diamond powder as used in Example 1 were coated with platinum in a thickness of 1 μm by sputtering.

The platinum-coated bonding metal powder and the platinum-coated diamond powder were blended together in a mixing proportion of 90:10 by volume using a pestle and the powder mixture was subjected to a sintering treatment in the same manner as in Example 2 to give a sintered body having a porosity of 15%.

The sintered body was fabricated into a grinding wheel for grinding of glass which was used in a grinding test of glass plates in the same manner as in Example 1 to give the results of the grinding performance shown in Table 1.

The results shown in Table 1 indicate that a 15% extension of the wheel life or performance was obtained with the inventive grinding wheel prepared from the platinum-coated powders over that of the conventional grinding wheel and the grindability was improved with the inventive grinding wheel as is evidenced by the decrease of the electric current on the main shaft of the surface grinder by 1 ampere representing the grinding resistance.

TABLE 1

| | Grinding performance | |
|---|---|---|
| | Wear performance of wheel, number of works(1) | Grindability of ampere(2) |
| Example 1 | 1300 | 2 |
| Example 2 | 1200 | 2 |
| Example 3 | 1200 | 2 |
| Example 4 | 1150 | 2 |
| Example 5 | 1150 | 2 |
| Comparative grindstone | 1000 | 3 |

(1)number of the glass plates as ground before a 1 mm decrease in the diameter of the wheel by wearing
(2)electric current on the motor driving the main spindle of the surface grinder

What is claimed is:

1. A metal bonded diamond wheel which comprises a porous sintered body comprising a mixture of the bonding metal powder particles being coated with a layer of coating metal selected from the group consisting of iron, cobalt and nickel or an alloy mainly composed thereof, "said bonding metal being a metal other than said coating metal".

2. The metal bonded diamond wheel as claimed in claim 1 wherein the coating layer on the particles of the bonding metal powder has a thickness in the range from 0.5 μm to 15 μm.

3. The metal bonded diamond wheel as claimed in claim 1 wherein the particles of the diamond powder are provided with a coating layer of a metal belonging to the VIII th Group of the Periodic Table or an alloy mainly composed thereof.

4. The metal bonded diamond wheel as claimed in claim 3 wherein the coating layer on the particles of the diamond powder has a thickness in the range from 0.5 μm to 15 μm.

5. The metal bonded diamond wheel as claimed in claim 1 wherein the mixture is composed of from 5 to 95% by volume of the diamond powder and from 20 to 80% by volume of the bonding metal powder.

6. The metal bonded diamond wheel as claimed in claim 1 wherein (the bonding metal) is an (alloy of copper and tin) or an (alloy of copper and zinc.)

7. The metal bonded diamond wheel as claimed in claim 1 wherein the particles of the bonding metal have a diameter in the range from 10 μm to 500 μm.

8. The metal bonded diamond wheel as claimed in claim 1 wherein the particles of the diamond powder have a diameter in the range from 10 μm to 500 μm.

9. The metal bonded diamond wheel as claimed in claim 1 wherein said porus sintered body has a porosity of from 10% to 25%.

10. The metal bonded diamond wheel as claimed in claim 2 wherein the mixture is composed of from 5 to 95% by volume of the diamond powder and from 20 to 80% by volume of the bonding metal powder;

the bonding metal is (an alloy of copper and tin) or an (alloy of copper and zinc) and said porous sintered body has a porosity of from 10% to 25%.

11. The metal bonded diamond wheel as claimed in claim 10 wherein the diamond powder particles are coated with a layer of from 0.5 μm to 15 μm thick of a coating metal selected from the group consisting of iron, cobalt and nickel or an alloy mainly composed thereof.

12. The metal bonded diamond wheel as claimed in claim 11 wherein the diamond powder and the bonding metal powder are both coated with the same coating metal and the particles of the bonding metal and the particles of the diamond powder each have a diameter of from 10 μm to 500 μm.

13. The metal bonded diamond wheel as claimed in claim 12 wherein said bonding metal powder is a bronze powder.

14. The metal bonded diamond wheel as claimed in claim 13 wherein said coating metal is nickel and said bonding metal powder and said diamond powder each have a coating layer of from 1 to 10 μm.

15. The metal bonded diamond wheel as claimed in claim 14 wherein said porous sintered body has a porosity of from 15 to 20%.

16. The metal bonded diamond wheel as claimed in claim 15 wherein said bonding metal powder and said diamond powder are in a proportion of 90:10 by volume.

17. The metal bonded diamond wheel as claimed in claim 13 wherein said coating metal is iron and said bonding metal powder and said diamond powder each have a coating layer of from 1 to 10 μm.

18. The metal bonded diamond wheel as claimed in claim 17 wherein said porous sintered body has a porosity of from 15 to 20%.

19. The metal bonded diamond wheel as claimed in claim 18 wherein said bonding metal powder and said diamond powder are in a proportion of 90:10 by volume.

20. The metal bonded diamond wheel as claimed in claim 1 wherein said bonding metal powder is a bronze powder.

21. The metal bonded diamond wheel as claimed in claim 10 wherein said bonding metal powder is a bronze powder.

* * * * *